United States Patent [19]

Dela Rosa

[11] Patent Number: 4,877,239

[45] Date of Patent: Oct. 31, 1989

[54] THIGH MUSCLE STRETCHING DEVICE

[76] Inventor: Gregorio Dela Rosa, 3117 Laconia La., Aurora, Ill. 60504

[21] Appl. No.: 292,836

[22] Filed: Jan. 3, 1989

[51] Int. Cl.[4] ..... A63B 23/04; A61H 1/02

[52] U.S. Cl. ..... 272/126; 272/134; 272/116; 272/143; 272/144; 272/903

[58] Field of Search ..... 272/134, 116, 143, 144, 272/126, 903, 125; 128/75, 25 R; 269/325, 326, 327, 328; 254/98, 99, 100, 101

[56] References Cited

U.S. PATENT DOCUMENTS

| | | | |
|---|---|---|---|
| 2,921,772 | 1/1960 | Boyd | 254/100 |
| 3,134,379 | 5/1964 | Nightingale | 128/75 |
| 3,323,366 | 6/1967 | DeLorme, Jr. et al. | 272/134 X |
| 3,599,964 | 8/1971 | Magni | 269/328 |
| 3,661,149 | 5/1972 | Ferries | 128/25 R |
| 4,277,062 | 7/1981 | Lawrence | 272/126 |
| 4,426,071 | 1/1984 | Klevstad | 269/325 |
| 4,445,684 | 5/1984 | Ruff | 272/134 |
| 4,456,247 | 6/1984 | Ehrenfried | 272/126 |
| 4,549,534 | 10/1985 | Zagorski et al. | 128/75 X |
| 4,647,040 | 3/1987 | Ehrenfried | 272/126 |
| 4,655,200 | 4/1987 | Knight | 128/75 X |

OTHER PUBLICATIONS (Hurley Stretch Rack, Power Flex, Asian World of Martial Arts, Inc. Leg Stretcher #8400).

*Primary Examiner*—V. Millin
*Assistant Examiner*—Franklin L. Gubernick
*Attorney, Agent, or Firm*—James N. Videbeck

[57] ABSTRACT

An improved thigh muscle stretching device includes a central spine or post having a seat bottom on one end thereof, and an elongate worm gear mounted for free rotation adjacent the opposing end of the spine. A movable housing is threadedly received on the worm gear, and a pair of elongate rod members are dual-plane pivotally mounted on opposing sides of the housing. The distal ends of the rod members are adapted for receiving the legs of a user. Rotation of the worm gear is controlled by a multiple-plane pivoting handle positioned for user operation.

5 Claims, 2 Drawing Sheets

THIGH MUSCLE STRETCHING DEVICE

BACKGROUND OF THE INVENTION

This invention relates to exercise machinery, and more particularly, to devices suitable for stretching muscles of the thigh.

In several sports activities, particularly the martial arts, the ability to perform various kicks and other maneuvers requiring extreme movement of the thigh muscles, and particularly the adductor muscles in the interior of the thigh, is of paramount importance. In addition to utilizing free stretching movements, various exercising devices or machinery have been developed to assist one in stretching the adductor muscles of the inner thigh, and also to some extent the quadricep muscles at the front of the thigh, the hamstring muscles at the back of the thigh, and the abductor muscles at the outside of the thigh. U. S. Pat. Nos. 4,277,062; 4,456,247; 4,647,040; and 4,445,684 all disclose exercise devices which aid in stretching the inner or abductor muscles of the thigh. In the main, these devices work in only a single plane and involve the use of ropes, cables and the like to provide tension in the devices.

A need has arisen for an improved and simplified thigh muscle stretching machine which provides infinitely adjustable positive movement of its pivotally mounted stretching members and which is adapted for pivotal movement in more than one plane.

It is therefore an object of the present invention, generally stated, to provide a new and improved thigh muscle stretching device.

SUMMARY OF THE INVENTION

The invention resides in a device for aiding user stretching of adductor and other muscles of the thighs, the device comprises an elongate spine or main shaft having top and bottom sides and front and back ends. The device further includes a seat bottom which is retained on the top side of the spine adjacent its back end, and an elongate worm gear mounted for free rotation in spacial relation to the spine adjacent the front end thereof. The device also includes user operated means for rotating the worm gear in clockwise and counterclockwise directions. A movable housing having a threaded bore therethrough is engaged with the worm gear to travel substantially the length of the gear. The movable housing further includes a pair of elongate rod members with each mounted at one end to the housing assembly on opposing sides of the threaded bore therethrough. The elongate members each include a distal end having cushioning means thereon adapted for engaging a user's leg. The mounting between each of the one ends of the elongate rod members and the housing assembly includes means for pivoting each of the rod members in two perpendicular planes and any combination thereof relative to the moveable housing.

BRIEF DESCRIPTION OF THE DRAWINGS

The features of the present invention which are believed to be novel, are set forth with particularity in the appended claims. The invention may best be understood from the following detailed description of a currently preferred embodiment taken in conjunction with the accompanying drawings wherein like reference numerals refer to like parts and in which:

DETAILED DESCRIPTION OF THE PREFERRED EMBODIMENT

Figure 1:
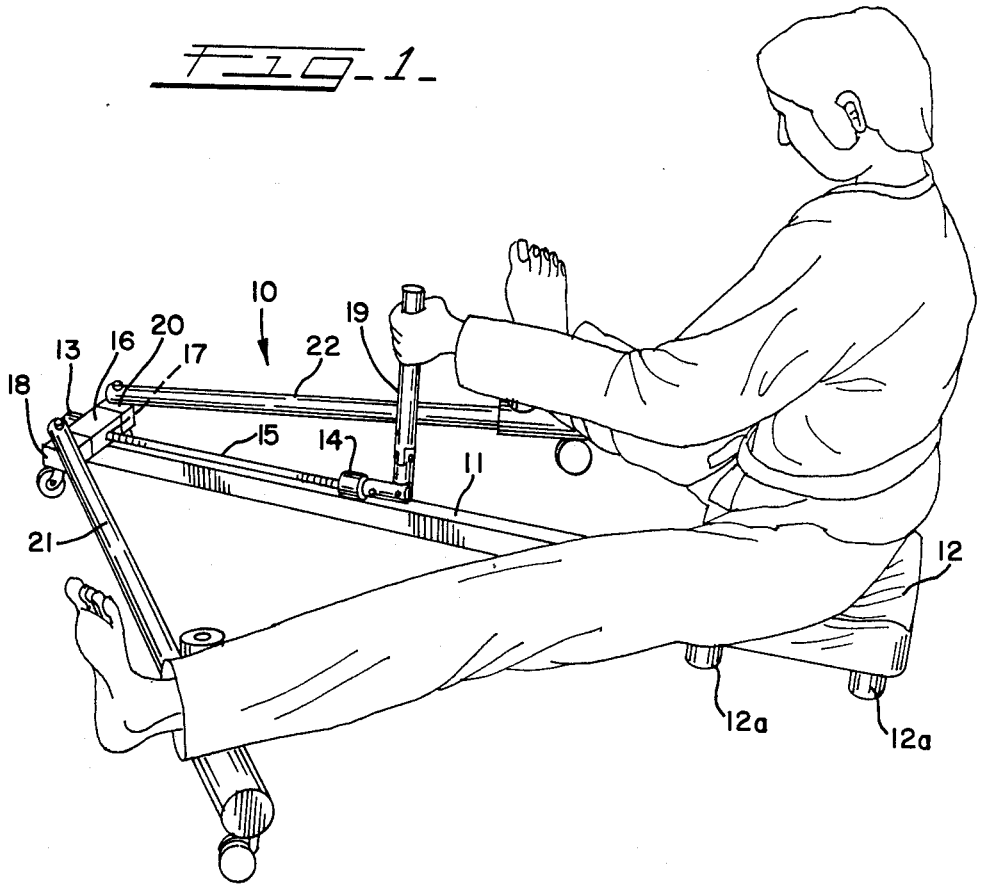
FIG. 1 is a perspective view of a thigh muscle stretching device constructed in accordance with the present invention as it appears when being operated by a user.
Figure 2:
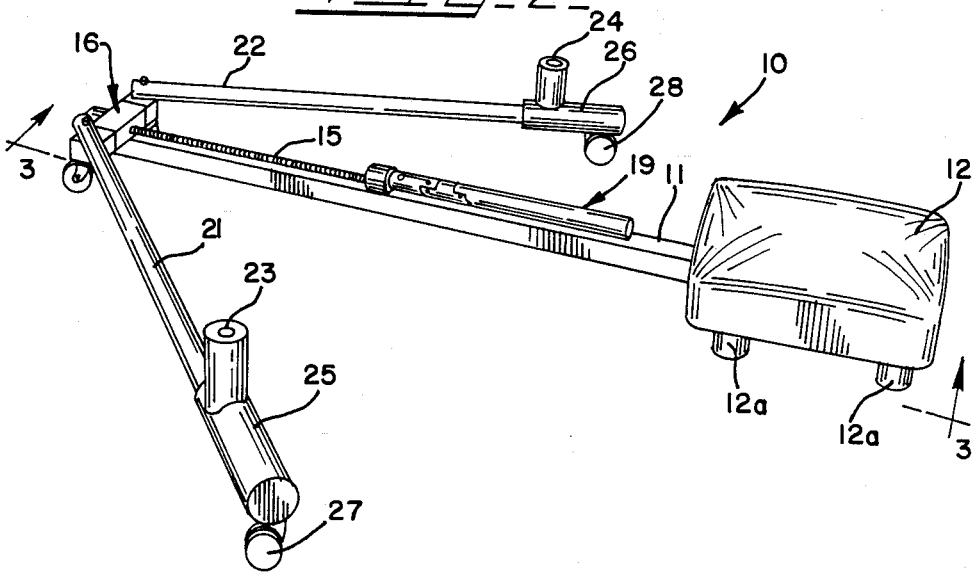
FIG. 2 is a perspective view of the thigh muscle stretching device shown in FIG. 1.
Figure 3:
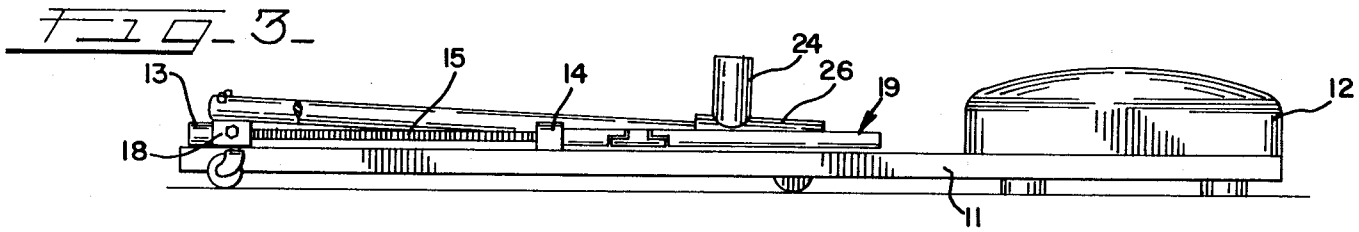
FIG. 3 is a fragmentary elevational view taken substantially along 3—3 of FIG. 2.

Referring to FIGS. 1, 2 and 3, the stretching device, generally indicated at 10, constructed in accordance with the present invention includes a central spine, backbone or shaft 11 having a seat cushion 12 mounted at the top rear thereof for providing comfortable seating for a user in the position shown in FIG. 1. Seat legs 12*a* and 12*a* stabilize the seat on any flat surface such as a floor. Adjacent the opposing end of the spine 11 is pair of pillow block type mounting members 13–14 which provide for free rotatable mounting of a worm gear 15 through each and therebetween. At the rear of worm gear 15 is positioned a multi-pivotal mounting handle 19 which may be manipulated for rotating worm gear 15 in either a clockwise or counterclockwise rotation by a user, as will be discussed below.

In between pillow blocks 13 and 14, and mounted on the worm gear 15 is a housing 16 which, in the preferred embodiment, is rectangular in shape with a threaded bore 17 positioned therethrough so that housing 16 may be infinitely adjustably positioned anywhere between pillow block 13 and pillow block 14 along worm gear 15 as desired, simply by rotation of the worm gear handle 16 by a user. The entire housing assembly 16 includes a pair of pivotally mounted members 18 and 20 which, in turn, are pivotally mounted to elongate tubular members 21, 22, respectively.

As most clearly shown in FIG. 2, the distal ends of elongate tubular members 21, 22 each include a vertically oriented stop member 23, 24, respectively which, along with the distal end of the tubular member, is covered with a foam type padding 25, 26, respectively. Also, caster wheel support members 27, 28 are mounted on the bottom side adjacent the distal ends of each of the elongate tubular members 21, 22 in order to provide for free movement of the distal ends of the tubular members on any horizontal surface on which the stretching device is positioned, and to maintain a relatively horizontal position of the elongate tubular members during use.

When in use, the exerciser sits on the seat cushion as shown in FIG. 1, and places the inner portion of each leg upwardly adjacent the ankle thereof against one of the vertical stop members 23, 24, respectively, so as to rest upon the padded distal portions 25, 26 of the elongate tubular members. The user's legs are in a comfortable beginning position forming a diamond shape with the user's legs and the elongate tubular members. Thereafter, the user rotates the worm gear 15 by rotation of the pivotally mounted handle 16 in a clockwise direction to bring the housing assembly 16 toward the rear pillow block 14 and thus increase the included angle between tubular member 21 and tubular member 22, thereby stretching the adductor muscles of the user's thighs. The amount of stretching is positively and continuously controlled by the user, as the user sees fit, and may be released, either by counterclockwise rotation of the handle 19 to decrease the included angle between elongate tubular members 21 and 22, or by vertical pivoting of one of the elongate tubular members which collapse the diamond type shape created by the elongate tubular members and the user's legs.

Figure 4:
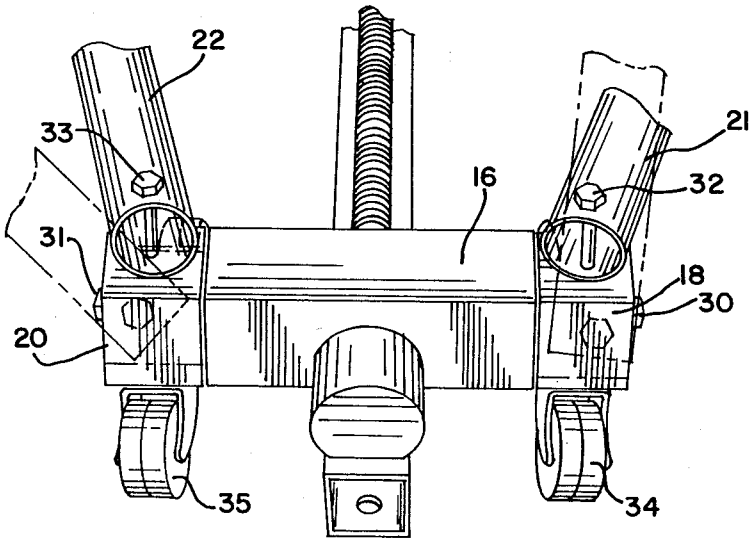
FIG. 4 is a perspective view of the pivot leg attachment housing assembly with the multi-plane pivotal movement of the leg or rod member shown in broken line.

Referring to FIG. 4, in one aspect of the present invention the vertical movement of the elongate tubular members 21, 22 is controlled by the multiple pivotal mounting of each of the tubular members to the housing 16 by way of the pivotal mounting members 18, 20. As shown most clearly in FIG. 4, the pivotal mounting member 18 is pivotally mounted to housing 16 by means of bolt 30, and pivotal mounting 20 is pivotally mounted to housing 16 by means of bolt 31, whereby each of pivotal mountings 18 and 20 are rotatable in a vertical plane around the bolts 30, 31, respectively. As a result of those pivotal mountings, the tubular members 21 and 22 may be moved vertically from the positions shown in solid line on FIG. 4 to the positions shown in dotted line thereon.

As also shown most clearly in FIG. 4, the forward end of the elongate tubular member 21 is pivotally mounted to the top surface pivotal mounting 18 by means of a bolt 32, and likewise, the forward end of elongate tubular member 22 is pivotally mounted to the top of pivotal mounting 20 by means bolt 33 to allow the tubular members to be rotated in a horizontal arc when the pivotal mounting members are in the positions shown in solid line FIGS. 1, 2 and 3. In order to have lateral stability at the front end of the stretching device, a castor wheel 34, 35 is mounted to the bottom of each of the pivotal mounting members 18, 20 respectively to deter any rolling motion of the stretching device during use.

Figure 5:
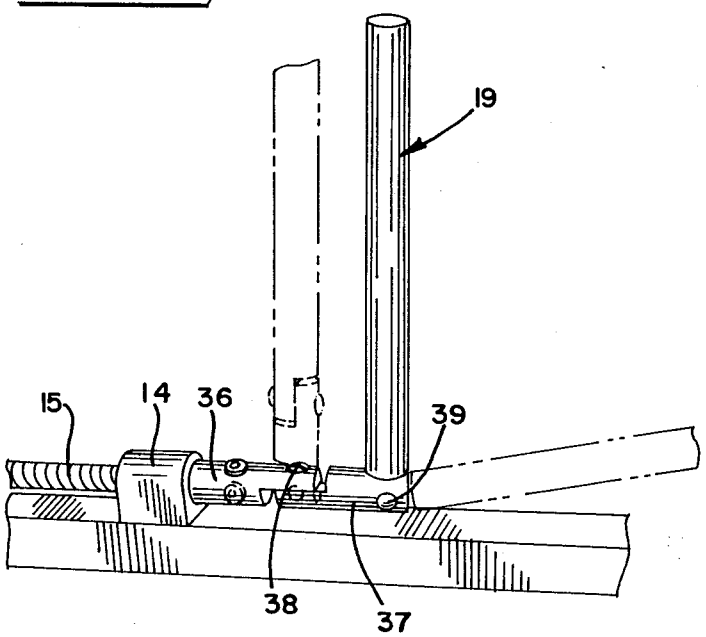
FIG. 5 is a fragmentary perspective view of the dual pivotal movement control handle for the worm gear drive showing various multi-planar pivotal movements of the handle in broken line.

Referring to FIG. 5, the handle 19 includes a mounting or base member 36 which is fastened to the worm gear 15 adjacent the rear pillow block 14. Between the base 36 and the handle distal end is positioned a central pivoting member 37 which is pivotally mounted to the base in one plane, and pivotally mounted to the handle 19 in a second plane perpendicular to the first plane by means of bolt members 38, 39 respectively. The dual plane pivotal mounting of the handle 19 to the worm gear 15 provides for multi-planar movement of the handle with respect to the worm gear, similar to the multiplanar movement of the elongate tubular members 21, 22 with respect to the housing 16.

Thus, a new and improved thigh muscle stretching device has been shown and described. While one embodiment of the present invention has been shown and described, it will be understood by those skilled in the art that changes and modifications may be made within the scope of the present invention. Therefore, the aim of the appended claims is to cover all such changes and modifications which may fall within the true spirit and scope of the present invention.

The invention is claimed as follows:

1. A device for aiding user stretching of adductor and other muscles of the thighs, said device comprising:

an elongate spine or main shaft having top and bottom sides and front and back ends;

a seat bottom retained on said top side of said spine adjacent said back end thereof;

an elongate worm gear mounted for free rotation in spatial parallel relation to said spine adjacent said front end thereof;

user operated means for rotating said worm gear in clockwise and counterclockwise directions;

a movable housing including a threaded bore therethrough which is engaged with said worm gear to travel substantially the length of said gear; and a pair of elongate rod members, each mounted at one end to said housing on opposing sides of said threaded bore therethrough, said elongate members each including a distal end having cushioning means thereon adapted for engaging a user's leg said mounting between each of said one ends of said elongate rod members and said housing assembly including means for pivoting each said rod member in two perpendicular planes, and any combination thereof relative said movable housing.

2. The device as defined in claim 1 wherein said means for pivoting each said rod member include a mounting member mediate said movable housing and each elongate rod member, each said mediate mounting member being pivotally mounted on said movable housing, and said one end of each said elongate member being pivotally mounted on said mediate mounting member perpendicularly to said pivotal mounting between said mediate mounting member and said movable housing.

3. The device as defined in claim 2 wherein each said mediate mounting member includes a support means secured thereon for engaging any flat surface on which said device is positioned when said elongate mounting member mounted thereto is in a position substantially parallel with said elongate spine.

4. The device as defined in ckaim 1 wherein said user operated means for rotating said worm gear includes a handle mounted on the end of said worm gear, said handle mounting being pivotal in two perpendicular olanes for allowing varied movement of said handle.

5. The device as claimed in claim 1 wherein said distal ends of each of said elongate rod members includes a support means secured thereto for engeging any flat surface on which said device is positioned when said elongate rod member is substantially parallel with said elongate spine.

* * * * *